United States Patent [19]

Cohen

[11] Patent Number: 4,844,151

[45] Date of Patent: Jul. 4, 1989

[54] HEAT EXCHANGER APPARATUS

[75] Inventor: Mordechai Cohen, San Diego, Calif.

[73] Assignee: Sundstrand Corporation, Rockford, Ill.

[21] Appl. No.: 945,909

[22] Filed: Dec. 23, 1986

[51] Int. Cl.[4] ..... B60H 1/00; F28F 3/00

[52] U.S. Cl. ..... 165/44; 165/166; 165/174

[58] Field of Search ..... 165/174, 166, 44; 62/525

[56] References Cited

U.S. PATENT DOCUMENTS

| | | | |
|---|---|---|---|
| 2,812,165 | 11/1957 | Hammond | 165/166 |
| 2,813,708 | 11/1957 | Frey | 165/174 |
| 2,930,553 | 3/1960 | Greenough | 165/41 X |
| 3,086,372 | 4/1963 | Barger et al. | 62/222 |
| 3,151,676 | 10/1964 | Otto et al. | 62/504 X |
| 3,358,470 | 12/1967 | Frediani | 62/196 |
| 3,683,637 | 8/1972 | Oshima et al. | 62/225 |
| 3,745,787 | 7/1973 | Ponziani | 62/504 |
| 3,976,128 | 8/1976 | Patel et al. | 165/153 |
| 4,089,368 | 5/1978 | Bell, Jr. et al. | 165/139 |
| 4,249,595 | 2/1981 | Butt | 165/166 X |
| 4,352,273 | 10/1982 | Kinsell et al. | 165/166 |
| 4,354,551 | 10/1982 | Kristoffersson et al. | 165/166 |
| 4,460,388 | 7/1984 | Fukami et al. . | |
| 4,524,728 | 6/1985 | Johnson | 165/166 X |
| 4,596,287 | 6/1986 | Wissonath | 165/166 X |
| 4,609,039 | 9/1986 | Fushiki et al. | 165/166 X |
| 4,676,305 | 6/1987 | Doty | 165/166 X |

*Primary Examiner*—Ira S. Lazarus
*Assistant Examiner*—Peggy Neils
*Attorney, Agent, or Firm*—Wood, Dalton, Phillips, Mason & Rowe

[57] ABSTRACT

A heat exchange apparatus which is particularly applicable for use in vehicles such as aircraft subject to high gravitational forces. A core provides superposed fluid flow paths extending longitudinally of the roll axis of the aircraft between opposite ends of the core and alternating in planes generally parallel to the pitch axis of the aircraft. Alternate ones of the flow paths carry a coolant between the opposite ends of the core, and the remaining flow paths carry a medium to be cooled. The alternate flow paths each include a plurality of flow passages extending between opposite ends of the core. A first fluid distributor at one end of the core evenly distributes coolant to the alternate flow paths. A second fluid distributor at the one end of the core evenly distributes coolant to the plurality of flow passages in each alternate flow path.

11 Claims, 2 Drawing Sheets

10
12
14
16
18
20
22
24
26
28
30
32
34
36
38
40
42
52
58
60
62
66
66a
70
A
B
C
D
3

HEAT EXCHANGER APPARATUS

FIELD OF THE INVENTION

This invention generally relates to heat exchangers and, particularly, to a heat exchange apparatus for use in vehicles such as aircraft subject to high gravitational forces.

BACKGROUND OF THE INVENTION

Heat exchangers are used in a wide variety of applications and often include alternating fluid flow paths, with alternate ones of the flow paths carrying a refrigerant or coolant and the remaining flow paths carrying a heated medium to be cooled. Some or all of the flow paths also may include separate flow passages defined by corrugated plates sandwiched between generally planar plates. Examples of such heat exchangers are shown in U.S. Pat. Nos. 3,151,676 to Otto et al, dated Aug. 17, 1961; 3,976,128 to Patel et al, dated Aug. 24, 1976; 4,352,273 to Kinsell et al, dated Oct. 5, 1982; and 4,460,388 to Fukami et al, dated July 17, 1984.

When such heat exchangers or evaporator systems are used in vehicles such as high performance aircraft, wherein the systems commonly are called vapor cycle cooling systems, continuing problems are encountered in maintaining an even distribution of the cooling medium, such as Freon. Such fluids utilized in these types of systems are subjected to varying, often high, "G" forces due to acceleration or deceleration of the aircraft and, equally as important, as a result of abrupt directional changes.

The above-described "G" forces make it quite difficult to insure good coolant or refrigerant distribution in the heat exchanger or evaporator. Without proper distribution, only a small portion of the evaporator may be provided with fluid, thus restricting the area through which heat transfer can occur. In other words, much of the heat transfer area between the Freon and the water or other medium would not be effectively employed. This operational characteristic substantially reduces the efficiency of the evaporator.

The invention is directed to solving these problems by providing a new and improved heat exchanger apparatus having a novel fluid distribution system.

SUMMARY OF THE INVENTION

An object, therefore, of the invention is to provide a new and improved heat exchanger having an improved fluid distribution system and, particularly, to such a heat exchanger which is readily applicable for use in vehicles such as high performance aircraft.

In the exemplary embodiment of the invention, the heat exchange apparatus generally includes a core providing superposed fluid flow paths extending longitudinally of the roll axis of the aircraft between opposite ends of the core and alternating in planes generally parallel to the pitch axis of the aircraft. Alternate ones of the flow paths carry a coolant, such as Freon, between the opposite ends of the core, and the remaining flow paths carry a medium, such as water, to be cooled. The alternate flow paths each include a plurality of flow passages extending between the opposite ends of the core.

The invention contemplates first fluid distributor means at one end of the core for evenly distributing the coolant to the alternate flow paths, and second fluid distributor means at the one end of the core for evenly distributing the coolant in each alternate flow path to the plurality of flow passages therein.

The first distributor means include a plurality of feed manifolds communicating with respective ones of the alternate flow paths. Each manifold includes a plurality of undulated fin strips arranged in a planar array and extending longitudinally in the direction of fluid flow to define cross passage means. Adjacent undulated fin strips are longitudinally offset relative to each other to define tortuous cross passage means.

The second fluid distributor means include a plurality of feed passages communicating with respective ones of the flow passages of each alternate flow path. A planar array of the feed passages is coincident with the plane of the given alternate flow path and extends generally perpendicular to the flow passages through the flow path. The feed passages connect with the respective flow passages along an interface line oblique to the direction of the flow path.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figures 1, 2, 3:
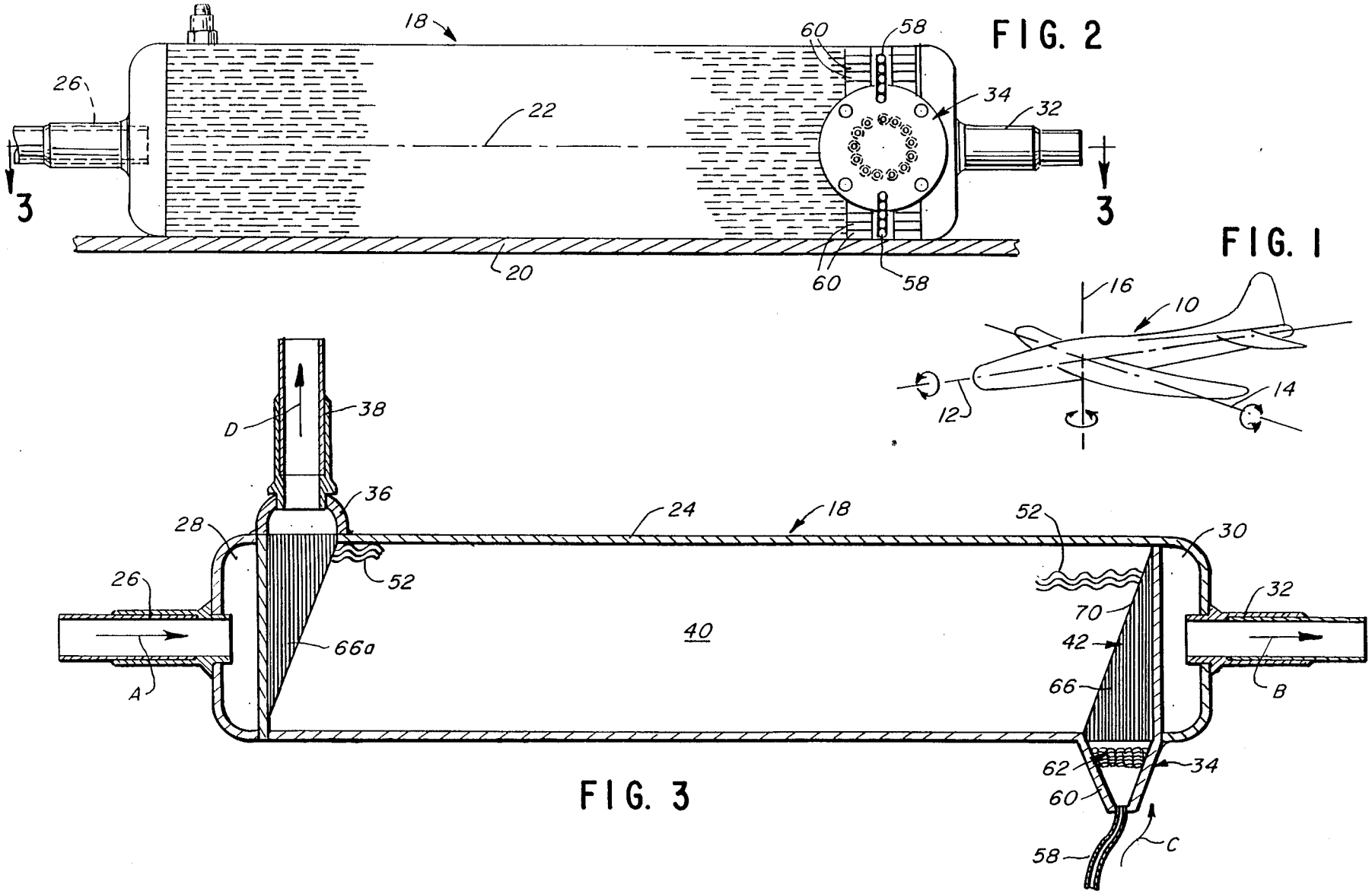
FIG. 1 is a somewhat schematic, perspective view of an aircraft to illustrate the roll and pitch axes thereof.
FIG. 2 is a side elevation, on an enlarged scale, of a heat exchange apparatus incorporating the concepts of the invention.
FIG. 3 is a horizontal section, on a further enlarged scale, taken generally along line 3—3 of FIG. 2.

Referring to the drawings in greater detail, and first to FIG. 1, a high performance aircraft generally designated 10, such as a jet fighter, is shown somewhat schematically to illustrate the location of the aircraft's roll axis 12, pitch axis 14 and yaw axis 16. Of course, this is conventional but is illustrated for subsequent reference purposes as to the direction of the various flow paths and passages through the heat exchange apparatus of this invention and its various fluid distributor means.

FIGS. 2 and 3 show a heat exchange apparatus, generally designated 18, which is mounted on an appropriate framework 20 (FIG. 2) on the interior of the aircraft. The heat exchanger is elongated with a generally centrally located axis 22 which extends generally parallel to the pitch axis 12 of the aircraft.

The heat exchanger includes a generally rectangular casing or housing 24, and a medium, such as water, is fed into the heat exchanger, as indicated by arrow "A", through an inlet conduit 26 and into an inlet header portion 28 at one end of housing 24. The water passes longitudinally through the heat exchanger and into an outlet header 30 at the opposite end of the heat exchanger. The ater exits through an exit conduit 32, as indicated by arrow "B". The refrigerant or coolant, such as Freon, enters the heat exchanger, as indicated by arrow "C", through a first fluid distributor means, generally designated 34, at the water exit end of the heat exchanger, and the refrigerant exits through an outlet header 36 and an outlet conduit 38 at the opposite or water inlet end of the heat exchanger, as indicated by arrow "D". Thus, it can be seen that the water and Freon generally pass through the heat exchanger longitudinally in opposite directions. Heat exchange occurs in a core, generally designated 40 (FIG. 3) extending between opposite ends of the heat exchanger.

Still referring to FIG. 3, the invention contemplates the aforesaid first fluid distributor means 34 at one end of core 40 for evenly distributing the Freon to a plurality of flow paths through the core, as described hereinafter, and a second fluid distributor means, generally designated 42, at the one end of the core for evenly distributing the Freon to the plurality of passages in each flow path.

Figure 6:
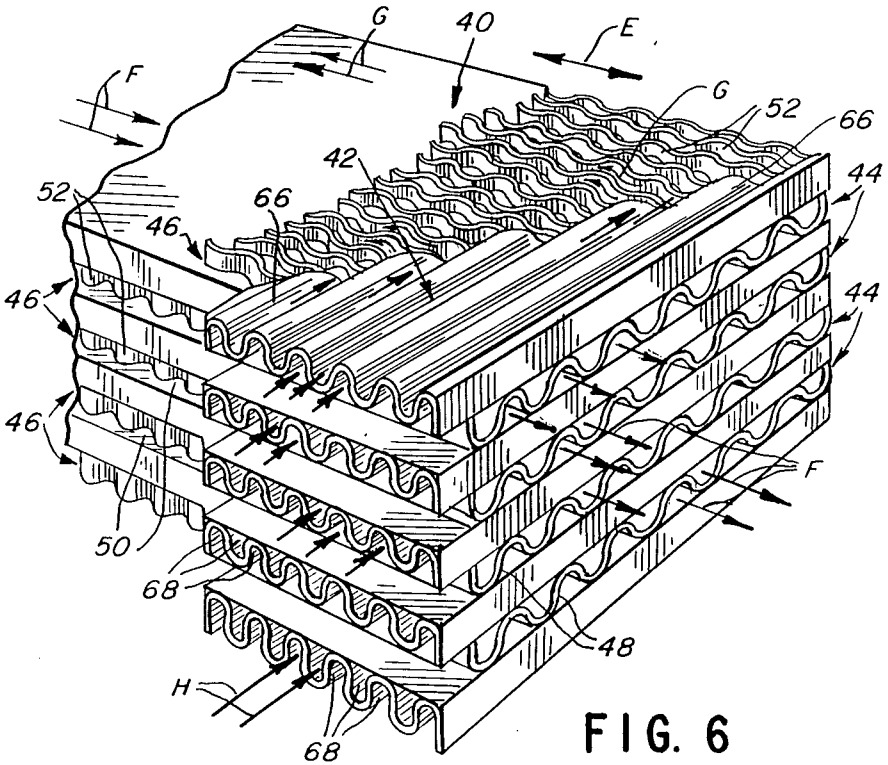
FIG. 6 is a fragmentd perspective view of one end of the heat exchanger core, illustrating the details of the second fluid distributor means for distributing coolant to the individual passages within the coolant flow paths through the heat exchanger.

FIG. 6 shows an isolated, fragmented portion of core 40 to illustrate the flow paths for the water and the Freon longitudinally through the core. Double-headed arrow "E" is shown to indicate the direction of axis 22 (FIG. 2) of heat exchanger 18 and roll axis 12 (FIG. 1) of aircraft 10.

More particularly, core 40 forms superposed fluid flow paths, generally designated 44 and 46, extending longitudinally of the roll axis of the aircraft between opposite ends of the core and alternating in planes generally parallel to the pitch axis of the aircraft. In other words, the flow paths are generally planar and horizontal when the aircraft is in level flight condition. Alternating flow paths 44 carry water longitudinally of the core and the heat exchanger, as indicated by arrows "F", and the remaining and alternating flow paths 46 carry the coolant or refrigerant, such as Freon, in alternating layers between the flow paths of water, but in an opposite direction, as indicated by arrows "G".

The superposed fluid flow paths themselves include a plurality of flow passages. Specifically, the flow passages in water flow paths 44 are defined by corrugated plates 48 sandwiched between alternating pairs of generally planar plates 50. The flow passages in coolant flow paths 46 are defined by a plurality of spaced, undulated fin strips 52 sandwiched between planar plates 50.

Figure 4:
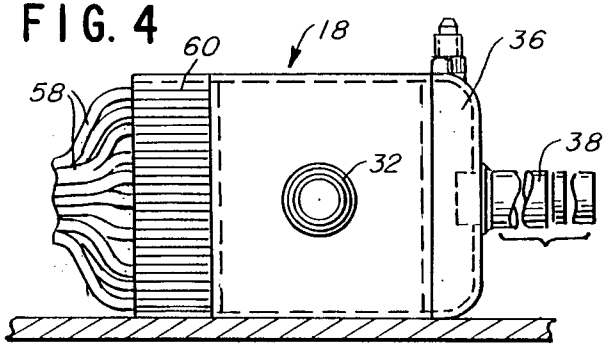
FIG. 4 is an elevational view looking at the right-hand end of the apparatus in FIG. 2.
Figure 5:
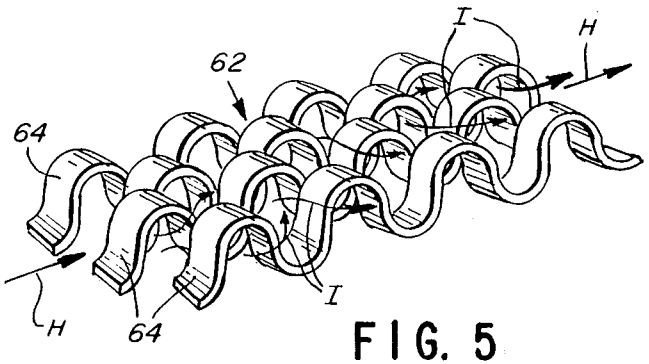
FIG. 5 is a perspective view, on an enlarged scale, of the undulated fin strips incorporated in the first fluid distributor means.

Referring to FIGS. 4 and 5 in conjunction with FIGS. 2 and 3, first fluid distributor means 34 includes a pump (not shown) for pumping Freon through a plurality of individually piped feed lines 58, one feed line for each flow path 46. As illustrated in FIG. 3, each individually piped feed line 58 leads to an individual manifold 60 configured for communication with a respective one of flow path 46. The fluid is further distributed or evened-out by baffle means, generally designated 62.

Referring specifically to FIG. 5, baffle means 62 comprises a plurality of undulated fin strips 64 arranged in a planar array and extending longitudinally in the direction of fluid flow, as indicated by arrows "H". Adjacent undulated thin strips 64 are longitudinally offset relative to each other to define tortious cross passage means whereby the fluid (Freon) flows back and forth transverse to the direction of flow, as indicated by arrows "I" as the fluid flows toward the core 40 (FIG. 6) and to the respective refrigerant flow path 46, generally perpendicular to the direction of flow through the flow path.

Second fluid distributor means 42 is best shown in FIG. 6 and is provided for evenly distributing the refrigerant to the plurality of flow passages defined by undulated fin strips 52 in Freon flow paths 46. More particularly, a triangularly shaped corrugated plate 66 is provided traversing each end of core 40 in the plane of each Freon flow path 46, whereby feed passages 68 formed by each corrugated plate 66 are in communication with respective flow passages formed between undulated fin strips 52. By cutting corrugated plate 66 in a triangular configuration, feed passages 68 connect or communicate with the flow passages between corrugated fin strips 52 along an interface line 70 (FIG. 3) oblique to the longitudinal axis 22 of the heat exchanger and the roll axis 12 of the aircraft. In this manner, fluid flowing transverse to flow paths 56, i.e. as indicated by arrows "H" in FIGS. 5 and 6, can communicate equally with the transverse feed passages 68 across the width of flow path 46.

As seen in FIG. 3, similar triangular corrugated plates **66*a* are provided at the Freon exit end of core 40 so that all of the flow pasages between corrugated fin strips 52 can exit perpendicularly away from the core and out of exit conduit 38**.

From the foregoing, it can be seen that first fluid distribution means 34, including the individually piped feed lines 58 and 60, evenly distribute the refrigerant to the alternating flow paths 46 through core 40. Second fluid distributor means 42 then evenly distribute the refrigerant to the plurality of individual flow passages between undulated fin strips 52 in each alternate refrigerant flow path 46. To insure that the refrigerant is distributed between first fluid distributor means 34 and second fluid distributor means 42, baffle means 62 (FIG. 5) provide a tortuous path for the refrigerant flow to further evenly distribute the refrigerant to feed passages 68 (FIG. 6) of second fluid distributor means 42.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A heat exchange apparatus for use in vehicles such as aircraft subject to high gravitational forces, the vehicle having a roll axis and a pitch axis, comprising:

a core providing superposed fluid flow paths extending longitudinally of the roll axis between opposite ends of the core and alternating in planes generally parallel to the pitch axis, whereby alternate ones of the flow paths carry a coolant between said ends and the remaining flow paths carry a medium to be cooled, and said alternate flow paths each including a plurality of flow passages extending between said opposite ends;

first fluid distributor means at one end of the core for evenly distributing coolant to said alternate flow paths, including a plurality of feed manifolds in communication with respective ones of said alternate flow paths, and baffle means in each manifold defining tortuous passage means for causing a turbulent flow of fluid substantially evenly across the entire respective alternate flow path; and second fluid distributor means at said one end of the core for evenly distributing coolant to said plurality of flow passages in each alternate flow path, said second fluid distributor means being in communication with respective ones of the feed manifolds of said first fluid distributor means.

2. The heat exchange apparatus of claim 1 wherein said second distributor means include a plurality of feed passages communicating with respective ones of said flow passages.

3. The heat exchange apparatus of claim 2 wherein said feed passages extend generally perpendicular to said flow passages.

4. The heat exchange apparatus of claim 3 wherein said feed passages for the respective flow passages of a given alternate flow path are arranged in a planar array coincident with the plane of the given alternate flow path.

5. The heat exchange apparatus of claim 4 wherein said feed passages extend generally perpendicular to the roll axis.

6. The heat exchange apparatus of claim 5 wherein said feed passages connect with said respective flow passages along an interface line oblique to the roll axis.

7. The heat exchange apparatus of claim 6 wherein said feed passages are defined by a corrugated spacer plate.

8. The heat exchange apparatus of claim 7 wherein said flow passages are defined by undulated spacer fins.

9. The heat exchange apparatus of claim 1 wherein each said feed manifolds include a plurality of undulated fin strips arranged in a planar array and extending longitudinally in the direction of fluid flow to define cross passage means, adjacent undulated fin strips being longitudinally offset relative to each other to define tortuous cross passage means.

10. A heat exchange apparatus, comprising:

a core providing superposed fluid flow paths extending longitudinally of an axis of the heat exchange apparatus between opposite ends of the core and alternating in planes generally parallel to the axis whereby alternate ones of the flow paths carry a coolant between said ends and the remaining flow paths carry a medium to be cooled; and fluid distributor means at one end of the core for evenly distributing ooolant to said alternate flow paths, inclduing a plurality of feed maifolds communicating with respective ones of the alternate flow paths, and baffle means in each manifold defining tortuous passage means for causing a trublent flow of fluid substantially evenly across the entire respective alternative flow path.

11. A heat exchange apparatus, comprising:

a core providing superposed fluid flow paths extending longitudinally of an axis of the heat exchange apparatus between opposite ends of the core and alternating in planes generally parallel to the axis whereby alternate ones of the flow paths carry a coolant between said ends and the remaining flow paths carry a medium to be cooled; and fluid distributor means at one end of the core for evenly distributing coolant to said alternate flow paths, including a plurality of feed manifolds communicating with respective ones of the alternate flow paths, and baffle means in each manifold defining tortuous passage means for causing a turbulent flow of fluid substantially evenly across the entire respective alternate flow path, said baffle means comprising a plurality of undulated fin strips arranged in a planar array and extending longitudinally in the direction of fluid flow to define cross passage means, adjacent undulated fin strips being longitudinally offset relative to each other to define tortuous cross passage means.

* * * * *